United States Patent [19]

Sakamoto et al.

[11] 4,200,391

[45] Apr. 29, 1980

[54] ELECTROSTATOGRAPHIC APPARATUS COMPRISING DOCUMENT DENSITY SENSING MEANS

[75] Inventors: Koji Sakamoto; Susumu Tatsumi; Chikara Imai, all of Tokyo, Japan

[73] Assignee: Ricoh Company, Ltd., Tokyo, Japan

[21] Appl. No.: 935,121

[22] Filed: Aug. 21, 1978

[30] Foreign Application Priority Data

Aug. 26, 1977 [JP] Japan ..... 52-102310

[51] Int. Cl.[2] ..... G03G 15/00

[52] U.S. Cl. ..... 355/14 E; 118/647; 250/205; 355/3 DD; 355/8; 355/14 D; 355/68

[58] Field of Search ..... 355/14, 3 DD, 10, 8, 355/11, 68, 69, 71; 118/647-651; 250/205, 208

[56] References Cited

U.S. PATENT DOCUMENTS

| | | | |
|---|---|---|---|
| 3,635,555 | 1/1972 | Kurahashi et al. | 355/8 |
| 4,093,376 | 6/1978 | Rabindran | 250/205 X |
| 4,124,295 | 11/1978 | Gardiner | 355/68 |

*Primary Examiner*—R. L. Moses

*Attorney, Agent, or Firm*—David G. Alexander

[57] ABSTRACT

Prior to optical scanning of an original document (14) for producing an electrostatic image thereof on a photoconductive drum (12), the optical density of the document (14) is sensed and a light image intensity and a developing bias voltage are set in accordance with a sensed minimum or background density of the document (14).

4 Claims, 10 Drawing Figures

ELECTROSTATOGRAPHIC APPARATUS COMPRISING DOCUMENT DENSITY SENSING MEANS

BACKGROUND OF THE INVENTION

The present invention relates to an electrostatographic apparatus such as an electrostatic copying machine.

In a dry process electrostatic copying machine a light image of an original document is focussed on an electrostatically charged photoconductive member to produce an electrostatic image through localized photoconduction. A dry toner substance is then applied to develop the electrostatic image and produce a toner image which is transferred and fixed to a copy sheet to provide a permanent reproduction of the original document.

To prevent white background areas of the original document from appearing gray in the copy, a bias voltage is applied to a developing unit which typically comprises a magnetic brush. The bias voltage is slightly lower than the potential of the background areas of the electrostatic image on the drum. In addition, to produce copies of proper density and contrast the light image intensity must be optimally controlled. This has been accomplished in the prior art by means of visual evaluation of the copies and manual control of the bias voltage and light image intensity. The latter may be controlled by adjustment of the intensity of illumination of the document or the width of an exposure aperture.

However, the problem is compounded by the fact that different original documents have different values of density and contrast. Proper setting of the bias voltage and light image intensity after visual evaluation of the document can only be accomplished by a highly skilled operator. An unskilled operator must make several trial copies and progressively adjust the settings until a satisfactory copy is obtained. Such a process is wasteful and time consuming.

To overcome this problem and provide automatic control of bias voltage and light image intensity, several attempts have been made heretofore. One prior art expedient is to increase the scanning stroke of the optical system so that the optical density of part of the document is sensed prior to imaging. The bias voltage and light image intensity are then set based on the sensed density and maintained constant during imaging. This system is disadvantageous in that the increased scanning stroke substantially increases the length of time required for the copying operation.

Another prior art proposal is to sense the optical density of a leading edge portion of the document during a first portion of the imaging operation and then set the light image intensity and bias voltage for the remainder of the imaging operation. Whereas this system does not increase the time required for copying, it is disadvantageous in that the density and constrast of the copy change abruptly at the point where the light image intensity and bias voltage were set.

SUMMARY OF THE INVENTION

An electrostatographic apparatus embodying the present invention includes a moving photoconductive member, optical means for illuminating and focussing a light image of a portion of an original document onto the photoconductive member, scanning means for producing relative scanning movement between the document, optical means and photoconductive member and developing means for developing an electrostatic image on the photoconductive member to produce a toner image. The present apparatus further comprises sensor means for sensing an optical density of the document prior to scanning movement and control means for controlling at least one of a light image intensity and a developing bias voltage in accordance with the sensed optical density.

It is an object of the present invention to provide an electrostatographic apparatus comprising means for optimally and automatically controlling a light image intensity and a developing bias voltage.

It is another object of the present invention to provide an electrostatographic apparatus which produces copies of proper density and contrast from all types of original documents.

It is another object of the present invention to provide an electrostatographic apparatus which achieves the above objects without increasing the length of time required for a copying operation.

It is another object of the present invention to provide a generally improved electrostatographic apparatus.

Other objects, together with the foregoing, are attained in the embodiments described in the following description and illustrated in the accompanying drawing.

DESCRIPTION OF THE PREFERRED EMBODIMENTS

While the electrostatographic apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
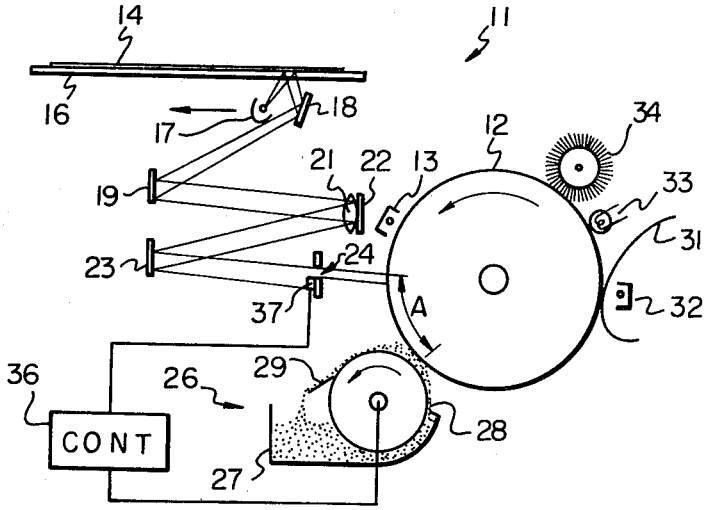
Fig. 1 PRIOR ART
FIG. 1 is a schematic view of a prior art electrostatographic apparatus.

Referring now to FIG. 1 of the drawing, a prior art electrostatographic apparatus is shown as being in the form of an electrostatic copying machine which is generally designated by the reference numeral 11. The copying machine 11 comprises a photoconductive drum 12 which is rotated counterclockwise at constant speed. The surface of the drum 12 is initially electrostatically charged by a corona charging unit 13. An original document 14 for electrostatic reproduction is placed face down on a transparent platen 16 which is fixed in position. A light source 17 illuminates a portion of the document 14 through the platen 16. A mirror 18 of an optical means reflects a light image of the portion of the document 14 which is illuminated by the light source 17 to a mirror 19 which reflects the image to a converging lens 21 having a reflecting rear surface 22. The light image is converged by the lens 21 twice and reflected therefrom to a mirror 23 which reflects the image through a slit 24 onto the drum 12. For scanning movement the mirror 18 and light source 17 are moved leftwardly at the same surface speed as the drum 12. The mirror 19 is also moved leftwardly but at one-half the surface speed of the drum 12. After scanning the entire surface of the document 14 the light source 17 and mirrors 18 and 19 are returned to their initial rightward positions. As a result of the scanning operation an electrostatic image of the document 14 is formed on the drum 12 through localized photoconduction.

A developing unit 26 comprises a developing tank 27 filled with dry toner substance and a magnetic brush 28 which is partially immersed in the toner and rotated counterclockwise at constant speed. The magnetic brush 28 applies toner to the drum 12 to develop the electrostatic image and produce a toner image. Further illustrated is a scraper 29 which removes toner from the magnetic brush 28 after development.

A copy sheet 31 is fed into engagement with the drum 12 and an electrostatic charge is applied to the back of the copy sheet 31 by a transfer charger 32. This causes the toner image to be transferred from the drum 12 to the copy sheet 31. Afterwards, a fixing unit (not shown) fixes the toner image to the copy sheet 31 to provide a permanent reproduction of the original document 14.

After the transfer operation is completed a lamp 33 uniformly radiates the drum 12 to discharge the same and a cleaning unit 34 removes any residual toner therefrom.

A photosensor 37 is provided to the slit 24 to sense the intensity of the light image and feed a signal corresponding thereto to a control unit 36. Based on the intensity of the light image, the control unit 36 adjusts a developing bias voltage applied to the magnetic brush 28 and the width of the slit 24.

Figure 2A:
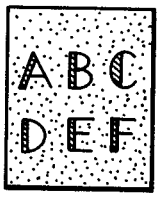
FIGS. 2*a*, 2*b* and 2*c* are diagrams illustrating a principle of the present invention.

Assuming that the developing bias voltage and light image intensity are set to provide a good copy of a normal original document, if no adjustment is made and a low density, low contrast original document is copied, the resulting copy will appear as in FIG. 2*a*. It will be noted that the background appears gray and that the density of the letters is insufficient.

Figure 2B:
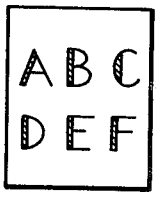

The gray background is made white by increasing the developing bias voltage as illustrated in FIG. 2*b*. However, the density of the letters is still insufficient.

Figure 2C:
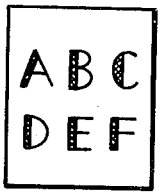

To produce a good copy of sufficient density and contrast, both the light image intensity and developing bias voltage must be increased. The result of this adjustment is illustrated in FIG. 2*c*.

The photosensor 37 senses the light image intensity of a leading edge portion of the document 14. Based on the sensed intensity the control unit 36 adjusts the width of the slit 24 and the developing bias voltage applied to the magnetic brush 28 and maintains these values constant for the remainder of the imaging operation. It is desirable to sense the light image intensity of the background areas of the document 14 and use this value to calculate the proper width of the slit 24 and developing bias voltage since the developing bias voltage is most dependent on this value.

The prior art apparatus 11 is disadvantageous in that there will be an abrupt change in the density and contrast of the copy at the point the light image intensity and developing bias voltage are set by the control unit 36. This abrupt change will occur between the leading edge portion which is sensed by the photosensor 37 and the remainder of the document 14. Such an abrupt change is unnatural and undesirable.

It will be noted that the leading edge of the electrostatic image on the drum 12 will move by a distance A before reaching the developing unit 26. Thus, the developing bias voltage may be adjusted within a time period A/V after the leading edge of the document 14 is scanned without producing an abrupt change in the copy. In this case V is the surface speed of the drum 14. However, there is no such lag time in adjustment of the width of the slit 24 and furthermore a significant length of time is required to move the mechanical members of the slit 24. Thus, an abrupt change in the density and contrast of the copy is unavoidable with the prior art configuration.

Figure 3:
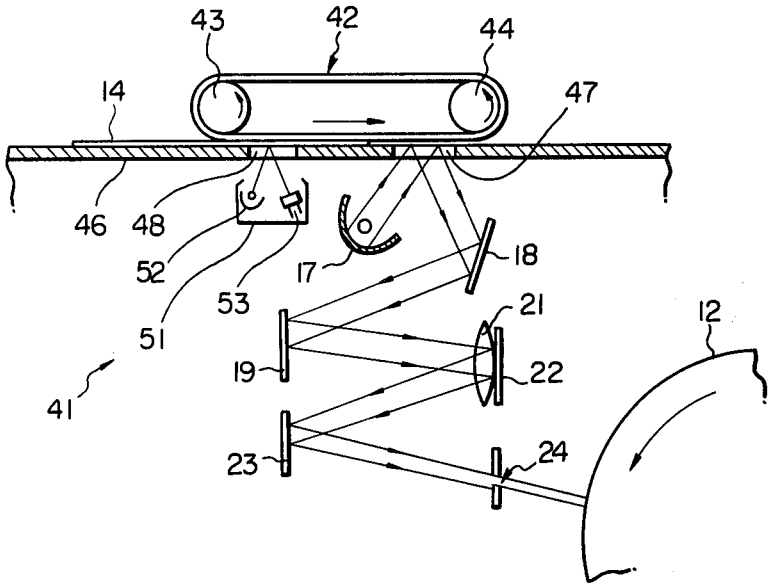
FIG. 3 is a schematic view of a first embodiment of the present invention.

FIG. 3 illustrates an apparatus 41 embodying the present invention which overcomes this problem and produces perfect copies from any type of original document. Like elements are designated by the same reference numerals used in FIG. 1.

In the apparatus 41 the mirrors 18 and 19 along with the light source 17 are fixed in position and the document 14 is moved relative thereto by a conveyor belt 42 which is trained around rollers 43 and 44. The belt 42 moves the document 14 rightwardly at the same surface speed as the drum 12. The platen 16 is replaced by a platen 46 which is opaque except for a transparent window 47 provided at an imaging position and a transparent window 48 provided at a sensing position upstream of the window 47. The light source 17 illuminates a portion of the document 14 through the window 47 and the mirror 18 reflects a light image of this portion onto the drum 12 via the other mirrors, etc. This scanning operation results in an electrostatic image of the document 16 being formed on the drum 12 in a manner similar to the apparatus 11.

The apparatus 41 further comprises a sensor unit 49 having a casing 51 mounted below the window 48. A light source such as a lamp 52 is mounted inside the casing 51 and illuminates a portion of the document 14 through the window 48. A photosensor such as a photodiode 53 is also mounted in the casing 51 and produces an output corresponding to the intensity of light reflected thereto from the document 14.

As the document 14 is moved past the window 48 the photosensor 53 produces an output corresponding to the sensed optical density thereof. It will be understood by those skilled in the art that the reflected light intensity corresponds to the density of the document 14. The control unit 36 samples and holds the maximum sensed light intensity value which corresponds to minimum optical density and sets the width of the slit 24 and the developing bias voltage in accordance therewith. In accordance with an important feature of the present invention, the optical density of the leading (right) edge portion of the document 14 is sensed and the width of the slit 24 and the developing bias voltage set before the leading edge of the document 14 reaches the window 47. Thus, it will be understood that the optical density of the document 14 is sensed during preparatory movement of the document 14 (movement to the window 47) and that the actual imaging or scanning operation is performed as the document 14 is moved past the window 47. The sensing and setting operation is completed before the imaging operation begins. Thus, the density and contrast of the copy are constant over the entire surface thereof.

Figure 4:
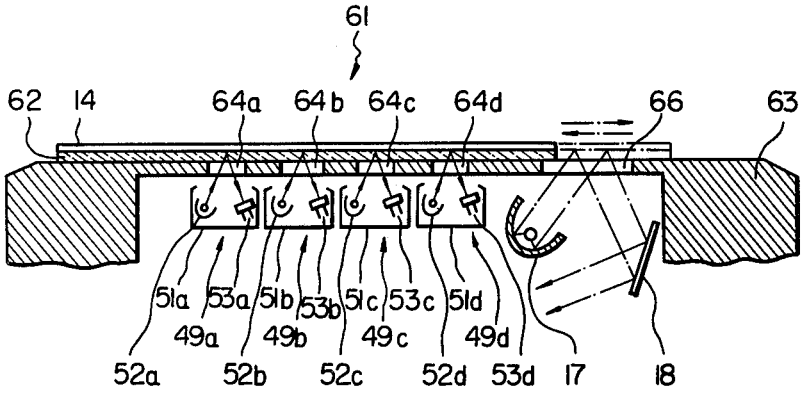
FIG. 4 is a schematic side elevation of a second embodiment of the present invention.
Figure 5:
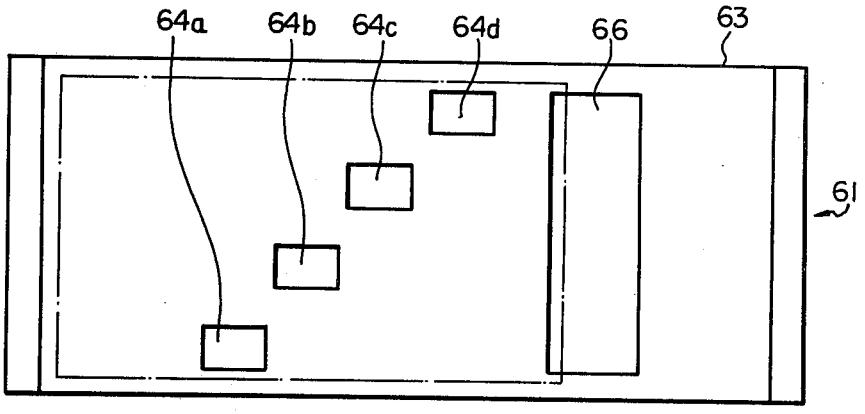
FIG. 5 is a plan view showing an arrangement of sensors of the embodiment of FIG. 4.

FIG. 4 illustrates another embodiment of the present invention which is designated as 61 and comprises a transparent platen 62 which is moved rightwardly for scanning. The platen 62 is slidably supported by a frame 63 which is formed with openings 64*a*, 64*b*, 64*c* and 64*d* upstream of an opening 66. As shown in FIG. 5, the openings 64*a*, 64*b*, 64*c* and 64*d* are diagonally arranged relative to the direction of movement of the document 14. The light source 17 and mirror 18 are arranged below the opening 66 which is provided at an imaging position.

Mounted below the openings 64*a*, 64*b*, 64*c* and 64*d* are sensor units 49*a*, 49*b*, 49*c* and 49*d* which comprise casings 51*a*, 51*b*, 51*c* and 51*d* respectively. Mounted inside the casings 51*a*, 51*b*, 51*c* and 51*d* are lamps 52*a*, 52*b*, 52*c* and 52*d* and photodiodes 53*a*, 53*b*, 53*c* and 53*d* in the same manner as the sensor unit 49.

The sensor units 49*a*, 49*b*, 49*c* and 49*d* sense the optical density of the document 14 at various respective points prior to the imaging operation. The sensing operation may be performed with the document 14 stationary or while the document 14 is moved to the opening 66. However, the sensing operation is preferably terminated before the leading edge of the document 14 reaches the opening 66. The apparatus 61 is advantageous in that it is possible to sense a relatively large area of the document 14 prior to setting of the developing bias voltage and light image intensity. In this case, the control unit 36 is adapted to sample and hold the highest light intensity value from the outputs of all of the photodiodes 53*a*, 53*b*, 53*c* and 53*d*.

Figure 6:
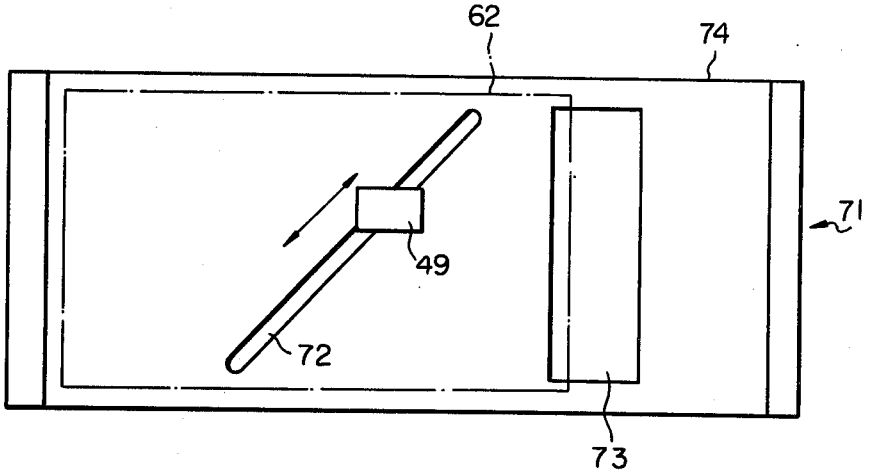
FIG. 6 is similar to FIG. 5 but shows another sensor arrangement.

FIG. 6 shows another apparatus 71 of the present invention which comprises a frame 74 formed with an opening 73 corresponding to the opening 66 and a diagonal opening 72. In this case, the sensor unit 49 is not fixed in position but is moved along the entire length of the opening 72 for sensing the density of the document 14 therethrough. The output of the sensor unit 49 is sampled and held and the value corresponding to the lowest value of optical density used to set the developing bias voltage and light image intensity. The diagonal arrangements of the openings in FIGS. 5 and 6 are advantageous in that they avoid erroneous sensing of the optical density of documents having patterns of orthogonal lines.

Figure 8:
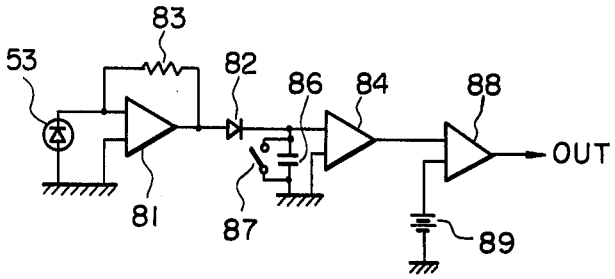
FIG. 8 is an electrical schematic diagram of the sensor arrangement of FIG. 3 or 6.

FIG. 8 shows the photodiode 53 and part of the control unit 36. The photodiode 53 is connected across the inputs of a differential amplifier 81, with the anode of the photodiode 53 being grounded. A feedback resistor 83 is connected between the output of the amplifier 81 and the cathode of the photodiode 53. The output of the amplifier 81 is also connected to the anode of a diode 82, the cathode of which is connected to an input of another differential amplifier 84. The cathode of the diode 82 is also connected to ground through the parallel arrangement of a capacitor 86 and normally open switch 87. The other input of the amplifier 84 is grounded. The output of the amplifier 84 is connected to an input of another differential amplifier 88, the other input of which is connected to a positive voltage source 89. The output of the amplifier 88 determines the developing bias voltage and light image intensity.

In operation, the output of the amplifier 81 increases as the intensity of the light incident on the photodiode 53 increases. This corresponds to a decrease in optical density of the document 14. The output of the amplifier 81 charges the capacitor 86 through the diode 82 which prevents the capacitor 86 from discharging. The diode 82, capacitor 86 and amplifier 84 constitute a sample and hold circuit which produces an output proportional to the maximum output voltage of the amplifier 81.

The voltage of the source 89 is selected to be higher than any possible output voltage of the amplifier 84. Thus, the amplifier 88 produces an output which is equal to the difference between the voltage of the source 89 and the output voltage of the amplifier 84. This difference decreases as the output voltage of the amplifier 84 increases. Thus, the output voltage of the amplifier 88 is a control signal which increases as the optical density of the background areas of the document 14 decreases. This control signal may be used either directly or indirectly to control the developing bias voltage and light image intensity. The switch 87 is closed to discharge the capacitor 86 prior to a new sensing operation.

Figure 7:
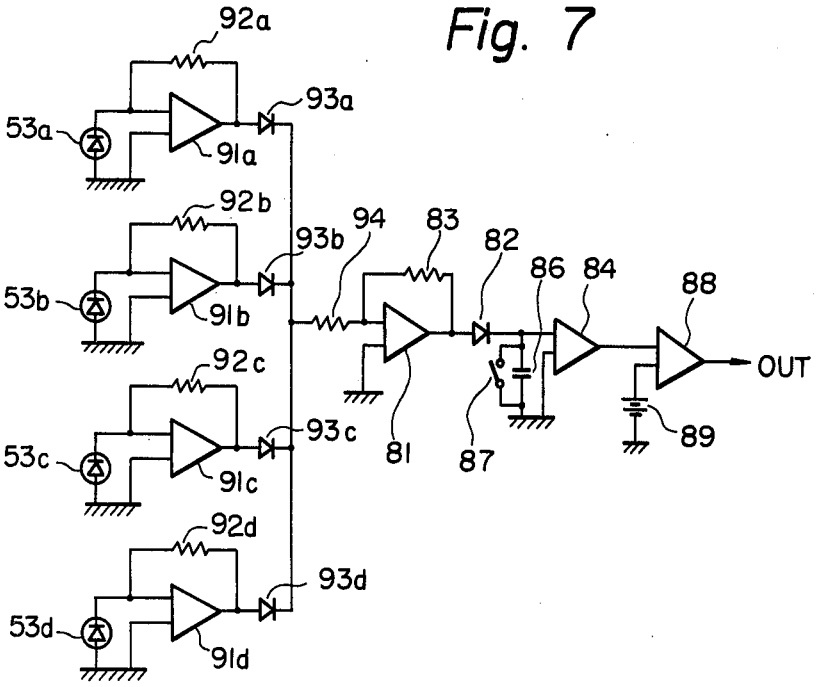
FIG. 7 is an electrical schematic diagram of the sensor arrangement of FIG. 5.

FIG. 7 illustrates a modified arrangement for the apparatus 61. The anodes of the photodiodes 53*a*, 53*b*, 53*c* and 53*d* are grounded and the cathodes thereof are connected to inputs of differential amplifiers 91*a*, 91*b*, 91*c* and 91*d* respectively. The other inputs of the amplifiers 91*a*, 91*b*, 91*c* and 91*d* are grounded and the outputs thereof connected to the cathodes of the photodiodes 53*a*, 53*b*, 53*c* and 53*d* through feedback resistors 92*a*, 92*b*, 92*c* and 92*d* respectively. The outputs of the amplifiers 91*a*, 91*b*, 91*c* and 91*d* are connected to the anodes of diodes 93*a*, 93*b*, 93*c* and 93*d* respectively, the cathodes of which are connected to the ungrounded input of the amplifier 81 through a resistor 94.

The amplifiers 91*a*, 91*b*, 91*c* and 91*d* produce outputs which increase as the intensity of light incident on the photodiodes 53*a*, 53*b*, 53*c* and 53*d* increases. The highest output voltage is applied through the respective diode 93*a*, 93*b*, 93*c* and 93*d* to the amplifier 81. The other diodes 93*a*, 93*b*, 93*c* and 93*d* are reverse biased and effectively disconnect the respective amplifier 91*a*, 91*b*, 91*c* and 91*d* from the amplifier 81. In this manner, the highest output voltage of all of the amplifiers 91*a*, 91*b*, 91*c* and 91*d* is automatically selected for application to the amplifier 81.

It will be understood that the prior art apparatus 11 may be adapted to operate in accordance with the present invention. This may be accomplished by normally maintaining the light source 17 and mirrors 18 and 19 in their leftmost positions. Then, they are moved to their rightmost positions while the density of the document 14 is sensed by the sensor 37. Then, they are moved leftwardly for the actual imaging or scanning operation.

In summary, it will be seen that the present invention overcomes the drawbacks of the prior art by providing an electrostatographic apparatus which automatically sets the light image intensity and developing bias voltage to produce perfect copies of any original document. This is accomplished without increasing the length of time required for a copying operation or producing abrupt changes in density or contrast on the finished copies.

Various modifications will become possible for those skilled in the art after receiving the teachings of the present disclosure without departing from the scope thereof. For example, the output of the amplifier 88 may set the light image intensity by adjusting the intensity of illumination of the document 14 rather than the width of the slit 24. Also, the openings 64*a*, 64*b*, 64*c* and 64*d* as well as the opening 72 may be arranged perpendicular, rather than diagonal to the direction of movement of the document 14. As yet another modification, the apparatus may be adapted to control only the developing bias voltage or only the light image intensity rather than both.

What is claimed is:

1. An electrostatographic apparatus including a moving photoconductive member, optical means for illuminating and focussing a light image of a portion of an original document onto the photoconductive member, scanning means for producing relative scanning movement between the document, optical means and photoconductive member and developing means for developing an electrostatic image on the photoconductive member to produce a toner image, characterized by comprising:

sensor means for sensing an optical density of the document prior to scanning movement; and control means for controlling at least one of a light image intensity and a developing bias voltage in accordance with the sensed optical density;

the optical means being fixed, the scanning means moving the document relative to the optical means through an imaging position, the sensor means being disposed upstream of the imaging position in a direction of movement of the document;

the sensor means comprising a plurality of sensors spaced from each other perpendicular to the direction of movement of the document;

the sensors also being spaced from each other in the direction of movement of the document.

2. An apparatus as in claim 1, in which the sensor means further comprises means for sampling and holding an output of the sensors corresponding to minimum sensed optical density.

3. An electrostatographic apparatus including a moving photoconductive member, optical means for illuminating and focussing a light image of a portion of an original document onto the photoconductive member, scanning means for producing relative scanning movement between the document, optical means and photoconductive member and developing means for developing an electrostatic image on the photoconductive member to produce a toner image, characterized by comprising:

sensor means for sensing an optical density of the document prior to scanning movement; and control means for controlling at least one of a light image intensity and a developing bias voltage in accordance with the sensed optical density;

the optical means being fixed, the scanning means moving the document relative to the optical means through an imaging position, the sensor means being disposed upstream of the document;

the sensor means comprising a sensor and means for moving the sensor diagonally relative to the direction of movement of the document.

4. An apparatus as in claim 3, further comprising means for sampling and holding an output of the sensor corresponding to minimum sensed optical density.

* * * * *